US010301965B2

(12) United States Patent
Shibukawa et al.

(10) Patent No.: US 10,301,965 B2
(45) Date of Patent: May 28, 2019

(54) STEAM TURBINE

(71) Applicant: KABUSHIKI KAISHA TOSHIBA, Minato-ku (JP)

(72) Inventors: Naoki Shibukawa, Saitama (JP); Yoshifumi Iwasaki, Yokohama (JP); Junichi Tominaga, Yokohama (JP); Shinichiro Ohashi, Ota (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 305 days.

(21) Appl. No.: 14/865,818

(22) Filed: Sep. 25, 2015

(65) Prior Publication Data

US 2016/0090861 A1 Mar. 31, 2016

(30) Foreign Application Priority Data

Sep. 26, 2014 (JP) ..... 2014-196892

(51) Int. Cl.
*F01D 25/12* (2006.01)
*F01D 19/00* (2006.01)
(Continued)

(52) U.S. Cl.
CPC ..... *F01D 25/12* (2013.01); *F01D 1/04* (2013.01); *F01D 5/10* (2013.01); *F01D 19/00* (2013.01);
(Continued)

(58) Field of Classification Search
None
See application file for complete search history.

(56) References Cited

U.S. PATENT DOCUMENTS 2,402,841 A 6/1944 Ray
3,885,822 A 5/1975 Cohen et al.
(Continued)

FOREIGN PATENT DOCUMENTS

EP 1 090 208 B1 5/2003
EP 2 216 506 A1 8/2010
(Continued)

OTHER PUBLICATIONS

JP 58-140407 (machine translation); Uchida, Hiroshi, published Aug. 20, 1983.*
(Continued)

*Primary Examiner* — Christopher Verdier
*Assistant Examiner* — Jason G Davis
(74) *Attorney, Agent, or Firm* — Oblon, McClelland, Maier & Neustadt, L.L.P.

(57) ABSTRACT

A steam turbine in an embodiment includes a casing, a turbine rotor, a rotor blade cascade, a stationary blade cascade, and a spray unit, the rotor blade cascade and the stationary blade cascade being each arranged at a plurality of stages alternately in an axial direction of the turbine rotor. The turbine rotor is housed inside the casing. In the rotor blade cascade, a plurality of rotor blades are arranged in a circumferential direction of the turbine rotor. In the stationary blade cascade, a plurality of stationary blades are arranged in the circumferential direction of the turbine rotor between a diaphragm inner ring and a diaphragm outer ring. The spray unit sprays spray water to a space located upstream from a rotor blade cascade at a final stage among the rotor blade cascades at the plurality of stages inside the casing.

13 Claims, 10 Drawing Sheets

(51) Int. Cl.

| | |
|---|---|
| ***F01D 1/04*** | (2006.01) |
| ***F01D 25/24*** | (2006.01) |
| ***F01D 5/10*** | (2006.01) |

(52) U.S. Cl.
CPC ..... *F01D 25/24* (2013.01); *F05D 2220/31* (2013.01); *F05D 2260/212* (2013.01)

(56) References Cited

U.S. PATENT DOCUMENTS

| | | | | |
|---|---|---|---|---|
| 6,233,937 | B1 * | 5/2001 | Gray | F01K 13/025 415/116 |
| 7,744,343 | B2 * | 6/2010 | Burdgick | F01D 11/005 415/144 |
| 7,903,700 | B2 * | 3/2011 | Nagai | H01S 3/134 372/20 |
| 2007/0292265 | A1 * | 12/2007 | Burdgick | F01D 5/147 415/169.3 |
| 2008/0075578 | A1 | 3/2008 | Burdgick et al. | |

FOREIGN PATENT DOCUMENTS

| | | | | | |
|---|---|---|---|---|---|
| JP | 56-72205 | A | | 6/1981 | |
| JP | 58013109 | A | * | 1/1983 | F01D 25/305 |
| JP | 58-140407 | A | | 8/1983 | |
| JP | 4-308301 | A | | 10/1992 | |
| JP | 05-202702 | | | 8/1993 | |
| JP | 06-066107 | | | 3/1994 | |
| JP | 2588415 | Y2 | | 1/1999 | |
| JP | 2002-516946 | A | | 6/2002 | |
| JP | 2008-002439 | | | 1/2008 | |
| JP | 2013-060931 | | | 4/2013 | |

OTHER PUBLICATIONS

JP 58013109 (machine translation), Tagami, Shigeru, published Jan. 25, 1983.*

Extended European Search Report dated Jan. 29, 2016 in European Patent Application No. 15186421.2.

Office Action dated Jan. 16, 2018 in Japanese Patent Application No. 2014-196892 with English translation, 7 pages.

* cited by examiner

STEAM TURBINE

CROSS-REFERENCE TO RELATED APPLICATION

This application is based upon and claims the benefit of priority from Japanese Application No. 2014-196892, filed on Sep. 26, 2014; the entire contents of which are incorporated herein by reference.

FIELD

Embodiments described herein relate generally to a steam turbine.

BACKGROUND

In steam turbines such as a low-pressure turbine, a vibrating stress may occur at a rotor blade under operating conditions with a low volume flow rate of main steam (in no-load operation at startup, in a low load operation, in operation under a low vacuum and so on). In particular, the rotor blade constituting a turbine stage at the final stage among a plurality of turbine stages has a large blade length, and therefore a large vibrating stress may occur thereat. This phenomenon occurs due to occurrence of a fluid exciting force in a flow field where the volume flow rate of main steam is low.

FIG. 9 is a view illustrating a part of a steam turbine. FIG. 9 schematically illustrates, for example, a part of a low-pressure turbine into which steam flows as a working fluid sequentially via a high-pressure turbine and an intermediate-pressure turbine. Additionally, in FIG. 9, flow fields occurring under the condition that the volume flow rate of steam is low are indicated by broken lines. In FIG. 9, the left side is the upstream side and the right side is the downstream side.

When the steam flows under the condition that the volume flow rate is low, reverse flow areas 203 occur near a rotor blade 202 of the turbine stage at the final stage composed of a stationary blade 201 and the rotor blade 202 as illustrated in FIG. 9. In the flow field where the reverse flow area 203 occurs, the flow becomes an unsteady state due to the rotation of the rotor blade 202, so that a fluid exciting force occurs at the rotor blade 202. In particular, a large fluid exciting force occurs near the tip of the rotor blade 202 and a large bending moment acts on the rotor blade 202, so that the vibrating stress becomes extremely large. An upper limit value $\sigma 1$ of the vibrating stress is prescribed in consideration of characteristics such as a fatigue limit of a material, a safety factor and so on. Therefore, the operating range of the steam turbine is limited to conditions under which the vibrating stress does not exceed the upper limit value $\sigma 1$.

FIG. 10 is a chart representing the relationship (vibrating stress characteristics) between the volume flow rate of the main steam and the vibrating stress of the rotor blade. In FIG. 10, the horizontal axis indicates the volume flow rate V of the main steam and a vertical axis indicates the vibrating stress $\sigma$.

As illustrated in FIG. 10, when the volume flow rate V is a predetermined rate V1, the vibrating stress $\sigma$ becomes the upper limit value $\sigma 1$. Therefore, when the volume flow rate V is lower than the predetermined rate V1, the vibrating stress $\sigma$ includes a part exceeding the upper limit value $\sigma 1$, and therefore the operating range of the steam turbine is limited to prevent the volume flow rate V from becoming lower than the predetermined rate V1. In other words, in the low load operation in which the flow rate of the main steam becomes low or the operation under a low vacuum in which a specific volume of the main steam becomes small, the load condition under which the operation is possible or the range of steam condition is limited.

In order to suppress occurrence of the vibration on the rotor blade at the final stage, various techniques have been proposed.

For example, it has been proposed that a plurality of rotor blades are coupled together to suppress the occurrence of the vibration. However, in this case, the range of the vibrating stress which can be suppressed is narrow, and it is not easy to sufficiently suppress the occurrence of the vibration in some cases.

Further, for example, it has been proposed that a part of steam discharged from the high-pressure turbine is inserted to the vicinity of the final stage of the low-pressure turbine via a by-pass line bypassing the high-pressure turbine and the intermediate-pressure turbine, to suppress the occurrence of the vibration. Besides, for example, it has been proposed that steam is inserted from the outside into the low-pressure turbine via a hollow part formed in a diaphragm outer ring, to suppress the occurrence of the vibration. However, in this case, there are many restraints such as an auxiliary boiler being required to supply the steam from the outside, a supply pipe system becoming large in scale, and a device being required to adjust the state of the steam to be inserted and so on. Therefore, the cost increases and the operation is not easy in some cases.

In addition to the above, under the condition that the volume flow rate of steam flowing through the turbine final stage is extremely low (at startup and so on), the rotation of the rotor blade at the final stage with a large blade length gives energy to the surroundings of the rotor blade, so that the temperature significantly increases. Therefore, the material strength of the rotor blade decreases and the thermal extension of the rotor blade may occur. For the countermeasures, it is generally performed to spray pure water to a turbine exhaust chamber to cool it. Sprayed spray water (liquid droplet) moves by the flow of the reverse flow area from the base side to the tip side of the rotor blade at the final stage to cool the rotor blade. On the other hand, spray water that has not evaporated due to heat exchange collides with the tip of the rotor blade at high speed in a liquid droplet state, so that damage may occur due to erosion.

In the above technique, under the condition that the volume flow rate of steam is low, it is not easy to sufficiently suppress the vibrating stress at the rotor blade in some cases. Further, it may be difficult to effectively suppress the temperature increase of the rotor blade and to sufficiently prevent erosion of the rotor blade and so on. As a result, it is not easy to widen the range of the operational steam flow rate in the steam turbine. In particular, the above-described problems become obvious in the rotor blade at the final stage with a large blade length, so that the conditions such as startup condition, load range, and vacuum degree condition are limited in some cases.

The problem to be solved by the present invention is to provide a steam turbine capable of easily widening the range of the operational steam flow rate and so on.

DETAILED DESCRIPTION

Figure 1:
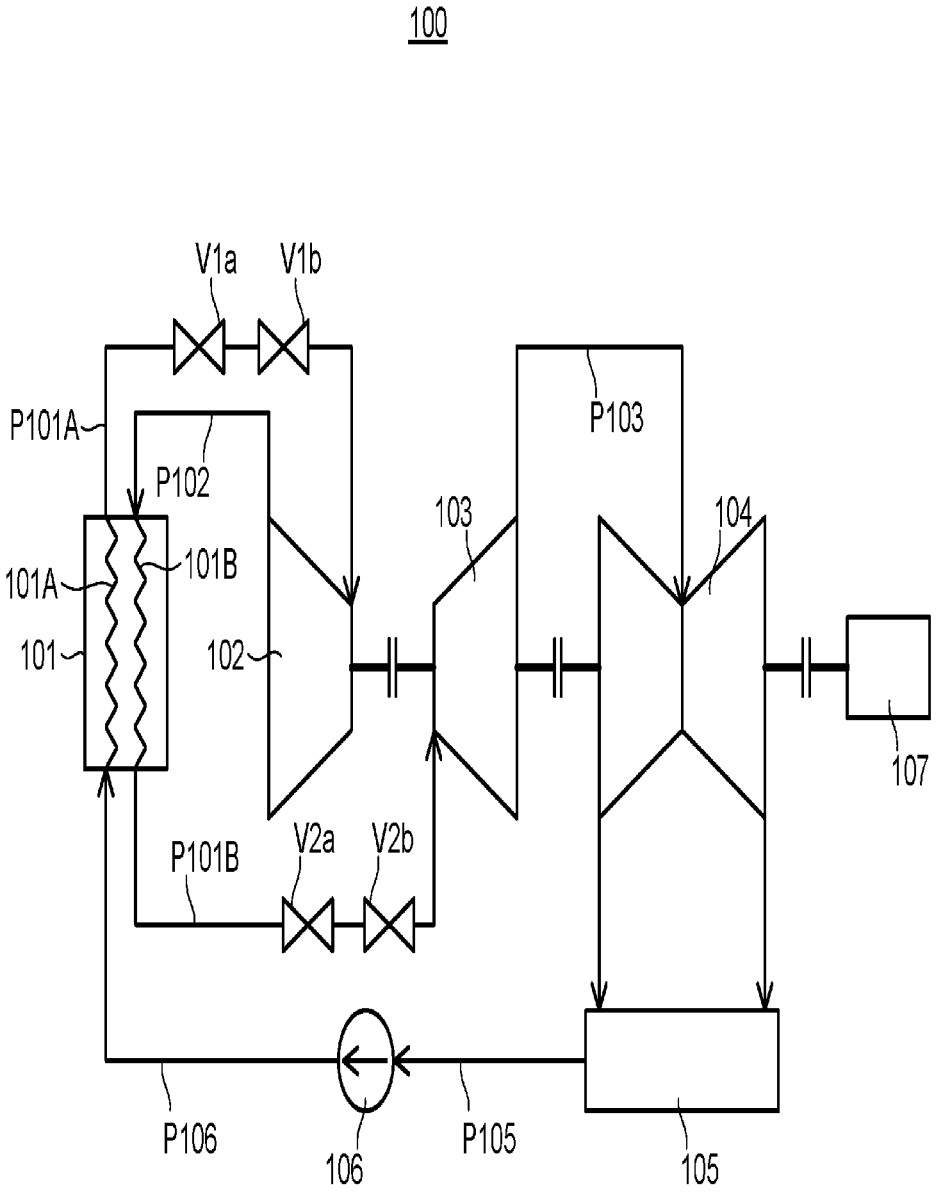
FIG. 1 is a diagram schematically illustrating a steam turbine power generation system in a first embodiment.

A steam turbine in an embodiment includes a casing, a turbine rotor, a rotor blade cascade, a stationary blade cascade, and a spray unit, the rotor blade cascade and the stationary blade cascade being each arranged at a plurality of stages alternately in an axial direction of the turbine rotor. Here, the turbine rotor is housed inside the casing. In the rotor blade cascade, a plurality of rotor blades are arranged in a circumferential direction of the turbine rotor. In the stationary blade cascade, a plurality of stationary blades are arranged in the circumferential direction of the turbine rotor between a diaphragm inner ring and a diaphragm outer ring. The spray unit sprays spray water to a space located upstream from a rotor blade cascade at a final stage among the rotor blade cascades at the plurality of stages inside the casing.

Embodiments will be described referring to the drawings. Note that the following embodiments are examples.

<First Embodiment>

[Configuration of a Steam Turbine Power Generation System]

FIG. 1 is a diagram schematically illustrating a steam turbine power generation system in a first embodiment.

A steam turbine power generation system 100 includes, as illustrated in FIG. 1, a boiler 101, a high-pressure turbine 102, an intermediate-pressure turbine 103, a low-pressure turbine 104, a steam condenser 105, a feed pump 106, and a power generator 107. In the steam turbine power generation system 100, the boiler 101 includes a superheater 101A and a reheater 101B.

As illustrated in FIG. 1, in the steam turbine power generation system 100, steam heated in the superheater 101A of the boiler 101 is supplied via a main steam pipe P101A in which a main steam stop valve V1*a* and a main steam control valve V1*b* are installed to the high-pressure turbine 102 as a working fluid, and works in the high-pressure turbine 102. Then, the steam discharged from the high-pressure turbine 102 is supplied via a low-temperature reheat steam pipe P102 to the reheater 101B of the boiler 101 and reheated in the reheater 101B. The steam reheated in the reheater 101B is supplied via a high-temperature reheat steam pipe P101B in which a reheated steam stop valve V2*a* and an intercept valve V2*b* are installed to the intermediate-pressure turbine 103 as a working fluid, and works in the intermediate-pressure turbine 103. Then, the steam discharged from the intermediate-pressure turbine 103 is supplied via a crossover pipe P103 to the low-pressure turbine 104 as a working fluid, and works in the low-pressure turbine 104. Then, the steam discharged from the low-pressure turbine 104 is condensed by the steam condenser 105. Water condensed in the steam condenser 105 (condensed water) is supplied via a pipe P105 to the feed pump 106 and increased in pressure, and then returned via a pipe P106 to the superheater 101A of the boiler 101.

In the steam turbine power generation system 100, turbine rotors (not illustrated) are coupled between the high-pressure turbine 102, the intermediate-pressure turbine 103, and the low-pressure turbine 104 so that the work by the steam rotates the turbine rotors. Then, the rotation of the turbine rotors drives the power generator 107 to generate power.

[Configuration of the Low-Pressure Turbine 104]

Figure 2:
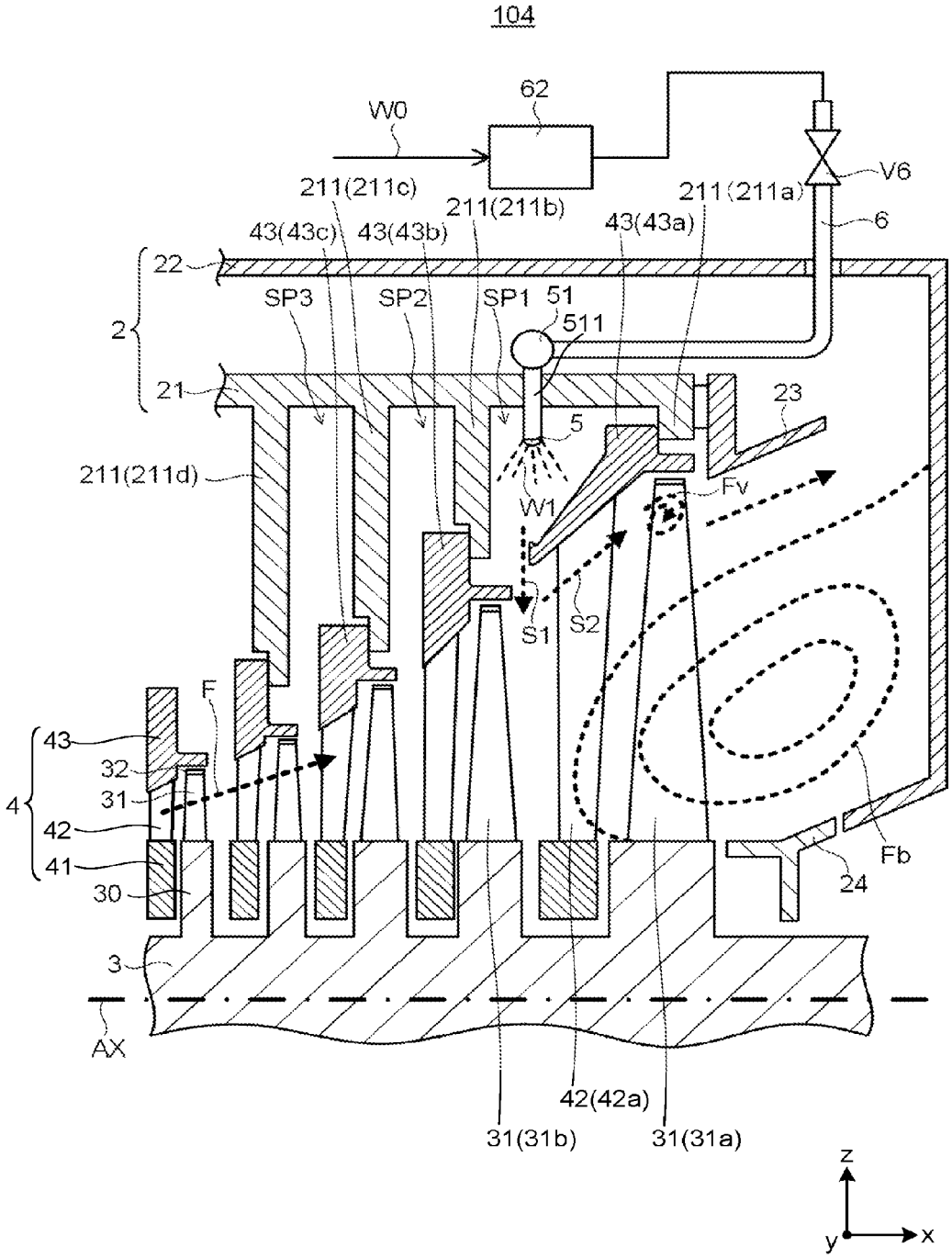
FIG. 2 is a view illustrating a low-pressure turbine in the steam turbine power generation system in the first embodiment.

FIG. 2 is a view illustrating the low-pressure turbine 104 in the steam turbine power generation system in the first embodiment. FIG. 2 illustrates a cross section of a vertical plane (xz plane) defined by an axial direction (x-diction) along a rotation axis AX of horizontal directions (x-direction, y-direction) and a vertical direction (z-direction). The low-pressure turbine 104 is of, for example, a double-flow exhaust type as understood from FIG. 1, and FIG. 2 schematically illustrates a part of the low-pressure turbine 104. Further, in FIG. 2, fluid and its flow field are indicated using heavy broken lines.

As illustrated in FIG. 2, the low-pressure turbine 104 has a casing 2, a turbine rotor 3, a nozzle diaphragm 4, a spray unit 5, and a water supply system 6. The low-pressure turbine 104 is of a multistage type in which a plurality of turbine stages are arranged along the rotation axis AX. In other words, the low-pressure turbine 104 is configured such that a rotor blade cascade and a stationary blade cascade are each arranged at a plurality of stages alternately along the rotation axis AX inside the casing 2.

Into the low-pressure turbine 104, steam (superheated steam) flows from an inlet (not illustrated) of the casing 2 as a working fluid F. Then, the flowed-in working fluid F flows in sequence through the plurality of turbine stages arranged along the rotation axis AX inside the casing 2. More specifically, as illustrated in FIG. 2, the working fluid F flows in sequence from the turbine stage at the initial stage to the turbine stage at the final stage, and inflates at each of the turbine stages to work (the working fluid F flows from the left side to the right side in a part illustrated in FIG. 2). This rotates the turbine rotor 3 around the rotation axis AX inside the casing 2. Then, the working fluid F flows out of the turbine stage at the final stage, and is then discharged from an outlet (not illustrated) of the casing 2 to the outside. The working fluid F discharged from the casing 2 flows to, for example, the steam condenser 105 (see FIG. 1) provided below the low-pressure turbine 104.

Hereinafter, details of units constituting the low-pressure turbine 104 will be described in sequence.

[Casing 2]

The casing 2 of the low-pressure turbine 104 has, as illustrated in FIG. 2, for example, a double structure, namely, an inner casing 21 and an outer casing 22. As for each of the inner casing 21 and the outer casing 22 in the casing 2, the inner casing 21 houses the turbine rotor 3 therein, and the outer casing 22 houses the inner casing 21 therein.

In the casing 2, the inner casing 21 is in a cylindrical shape in which a diaphragm support unit 211 is provided. The diaphragm support unit 211 is, for example, a ring-shaped plate body, and projects from the inner peripheral surface of the inner casing 21 to the inside in a radial direction of the rotation axis AX. The diaphragm support unit 211 is provided at a plurality of stages corresponding to the plurality of turbine stages, and the diaphragm support units 211 at the plurality of stages are arranged at intervals in an axial direction along the rotation axis AX. The plurality of diaphragm support units 211 become shorter in length in the radial direction of the rotation axis AX in sequence along a flow direction of the working fluid F. Further, each of the plurality of diaphragm support units 211 supports the nozzle diaphragm 4 at its surface on the upper stream side.

In addition to the above, in the casing 2, a steam guide 23 and an outlet cone 24 are provided. The steam guide 23 and the outlet cone 24 include a conical tubular part, and the outlet cone 24 is disposed inside the steam guide 23. Both of the steam guide 23 and the outlet cone 24 constitute a diffuser which is configured such that the working fluid F flowed out of the turbine stage at the final stage flows outward in the radial direction of the rotation axis AX.

Note that though illustration is omitted, the casing 2 is configured such that the working fluid F flowed between the steam guide 23 and the outlet cone 24 is discharged from a discharge port (not illustrated) formed at a bottom part of the outer casing 22 to the outside.

[Turbine Rotor 3]

The turbine rotor 3 of the low-pressure turbine 104 is a cylindrical rod-shaped body (shaft) and configured to rotate by means of the working fluid F flowing in the axial direction along the rotation axis AX. Here, the turbine rotor 3 has the rotation axis AX extending in the horizontal direction (x-direction), and penetrates the casing 2. The turbine rotor 3 is supported by bearings (not illustrated) at its one end part and another end part to be rotatable. As described above, the turbine rotor 3 has the one end part to which a power generator (not illustrated) is coupled, and the power generator is driven by the rotation of the turbine rotor 3 to generate power.

The turbine rotor 3 is formed with a rotor disk 30 at its outer peripheral surface. The rotor disk 30 is a ring-shaped plate body, and projects from the outer peripheral surface of the turbine rotor 3 to the outside in the radial direction of the rotation axis AX. A plurality of the rotor disks 30 are provided at intervals in the axial direction along the rotation axis AX. In addition, on the outer peripheral surface of the rotor disk 30, a rotor blade 31 is provided. A plurality of the rotor blades 31 are arranged at regular intervals along a circumferential direction of the turbine rotor 3. At the tips of the plurality of rotor blades 31 arranged in the circumferential direction, a shroud ring 32 is installed such that the shroud ring 32 connects the plurality of the rotor blades 31.

The rotor blade cascade in which the plurality of rotor blades 31 are arranged in the circumferential direction is installed at the plurality of stages corresponding to the plurality of turbine stages, and the rotor blade cascades at the plurality of stages are arranged at intervals in the axial direction along the rotation axis AX. Here, the rotor blades 31 at the turbine stages are longer in length in the radial direction of the rotation axis AX in sequence along the flow direction of the working fluid F. In short, a rotor blade 31*a* (L-0 stage rotor blade) at the final stage is longer than the rotor blades at the other stages.

[Nozzle Diaphragm 4]

The nozzle diaphragm 4 of the low-pressure turbine 104 has, as illustrated in FIG. 2, a diaphragm inner ring 41, a stationary blade 42, and a diaphragm outer ring 43, and is housed inside the inner casing 21. The nozzle diaphragm 4 is arranged around the turbine rotor 3 in the radial direction of the rotation axis AX.

In the nozzle diaphragm 4, the diaphragm inner ring 41 is in a ring shape and located between the rotor disks 30 provided at the turbine rotor 3. A plurality of the stationary blades 42 are installed between the diaphragm inner ring 41 and the diaphragm outer ring 43. The plurality of stationary blades 42 are arranged at regular intervals along the circumferential direction in an annular flow path formed between the diaphragm inner ring 41 and the diaphragm outer ring 43. The diaphragm outer ring 43 is in a ring shape and located outside the diaphragm inner ring 41 in the radial direction of the rotation axis AX. The diaphragm outer ring 43 is fixed to the diaphragm support unit 211 provided at the inner casing 21. Though not illustrated, spacing between the inner peripheral surface of the diaphragm inner ring 41 and the outer peripheral surface of the turbine rotor 3 is sealed by a sealing device (not illustrated). Similarly, spacing between the inner peripheral surface of the diaphragm outer ring 43 and the outer peripheral surface of the shroud ring 32 is sealed by a sealing device (not illustrated). Note that the shroud ring 32 is not provided in some cases.

The nozzle diaphragm 4 is installed at a plurality of stages corresponding to the plurality of turbine stages in the casing 2. In other words, the stationary blade cascade in which the plurality of stationary blades 42 are arranged in the circumferential direction of the turbine rotor 3 is installed at the plurality of stages similarly to the rotor blade cascades. The nozzle diaphragms 4 at the plurality of stages are arranged at intervals in the axial direction along the rotation axis AX. Here, the stationary blades 42 at the turbine stages are longer in length in the radial direction of the rotation axis AX in sequence along the flow direction of the working fluid F. In short, a stationary blade 42*a* (L-0 stage stationary blade) at the final stage is longer than the stationary blades at the other stages.

[Spray Unit 5]

The spray unit 5 is a spray device and has, as illustrated in FIG. 2, a spray head formed to spray spray water W1 (waterdrop). For example, the spray unit 5 performs spray so that the spray water W1 (waterdrop) diffuses in a conical shape.

In this embodiment, the spray unit 5 is installed to spray the spray water W1 in a space SP1 (L-0 pre-extraction chamber) demarcated by a diaphragm outer ring 43*a* (L-0 stage diaphragm outer ring) provided in the stationary blade cascade at the final stage among the plurality of diaphragm outer rings 43 and the inner casing 21. In other words, the spray unit 5 is installed in the space SP1 located between a diaphragm support unit 211*a* provided at the final stage and a diaphragm support unit 211*b* provided at a stage one stage before the final stage and between the outer peripheral surface of the diaphragm outer ring 43*a* at the final stage and the inner peripheral surface of the inner casing 21.

Here, the spray unit 5 is supplied with cooling water W0 (liquid phase water) from the water supply system 6 via a manifold 51 and sprays the cooling water W0 as the spray water W1.

Figure 3:
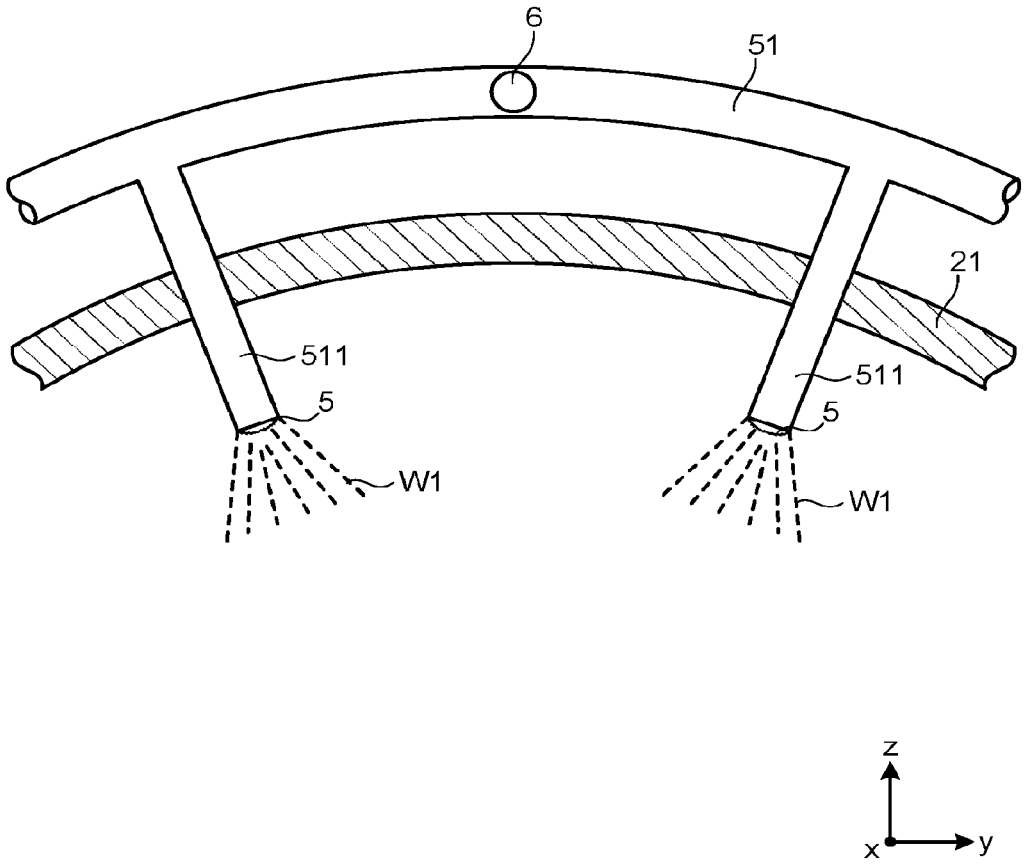
FIG. 3 is a view illustrating a detailed configuration of spray units and a manifold in the low-pressure turbine in the first embodiment.

FIG. 3 is a view illustrating a detailed configuration of the spray unit 5 and the manifold 51 in the low-pressure turbine 104 in the first embodiment. FIG. 3 illustrates a part of a vertical plane (yz plane) perpendicular to the axial direction (x-direction) along the rotation axis AX.

As illustrated in FIG. 3, the manifold 51 is a ring-shaped pipe surrounding the outer peripheral surface of the inner casing 21 in a circumferential direction. To the manifold 51, the water supply system 6 is coupled. Further, to the manifold 51, a plurality of pipes 511 (spray pipes) extending in the radial direction are coupled on the inner peripheral side. The plurality of pipes 511 are arranged at predetermined intervals in the circumferential direction, and penetrate the inner casing 21. Spacing between the plurality of pipes 511 and the inner casing 21 is sealed by, for example, welding. Further, each of the plurality of pipes 511 has the spray unit 5 installed at its tip on the inside. In other words, a plurality of the spray units 5 are arranged at predetermined intervals in the circumferential direction of the turbine rotor 3.

[Water Supply System 6]

The water supply system 6 has, as illustrated in FIG. 2, a pipe through which the cooling water W0 (liquid phase water) to be supplied to the spray unit 5 flows. The water supply system 6 penetrates the outer casing 22 and supplies the cooling water W0 from the outside of the casing 2 to the spray unit 5.

In this embodiment, the water supply system 6 has a flow rate regulating valve V6 and uses the flow rate regulating valve V6 to regulate the flow rate of the cooling water W0 to be supplied to the spray unit 5. The flow rate is regulated, for example, by a manual operation.

Further, in this embodiment, a temperature regulator 62 is further installed so that the water supply system 6 supplies the cooling water W0 regulated in temperature by the temperature regulator 62 to the spray unit 5. The temperature is regulated, for example, by a manual operation.

[Regarding the Operation and Effect of the Spray Water W1]

Hereinafter, the operation and effect of the spray water W1 to be sprayed by the spray unit 5 will be described.

Figure 9:
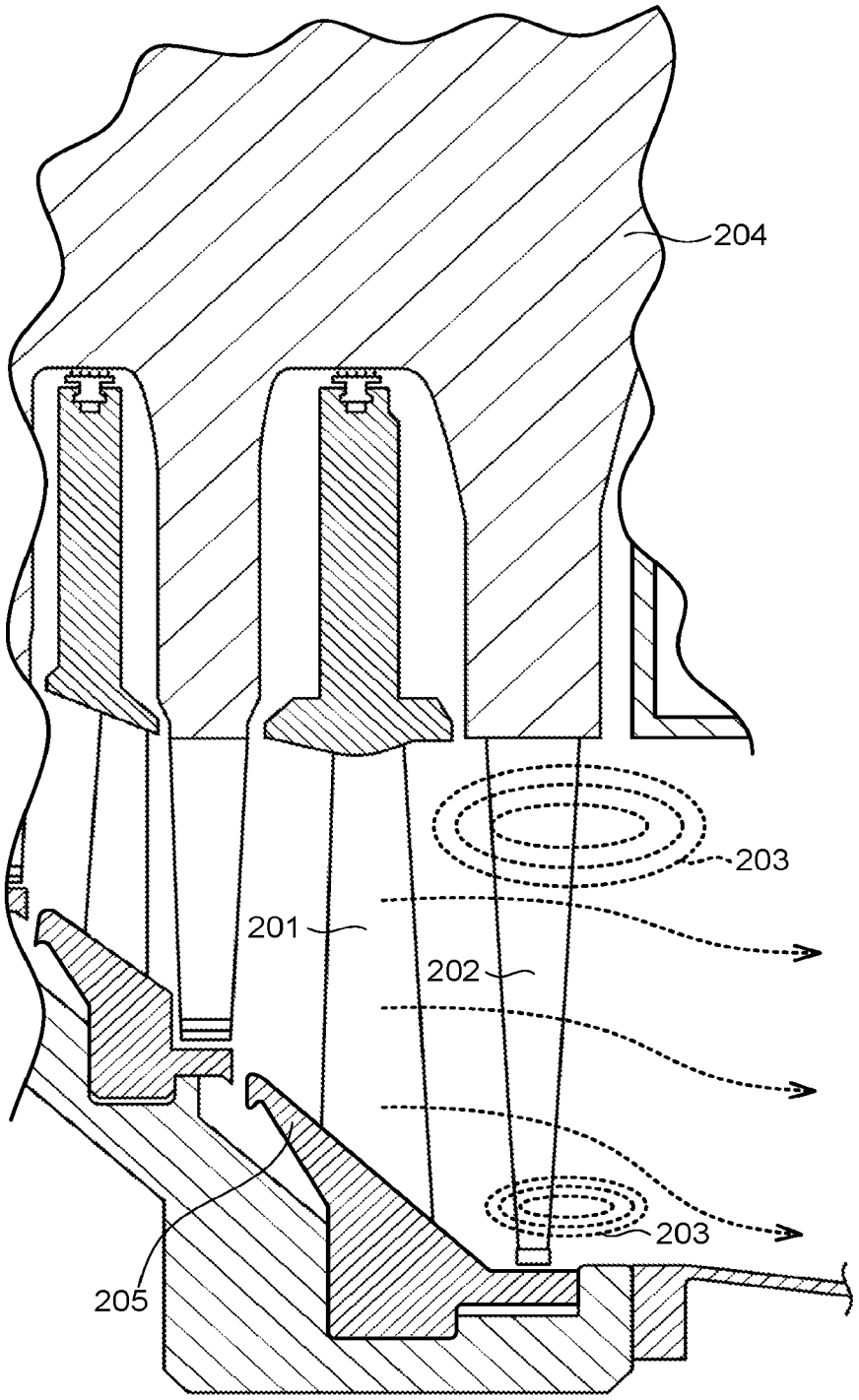
FIG.9 Related Art
FIG. 9 is a view illustrating a part of a steam turbine according to a related art.
Figure 10:
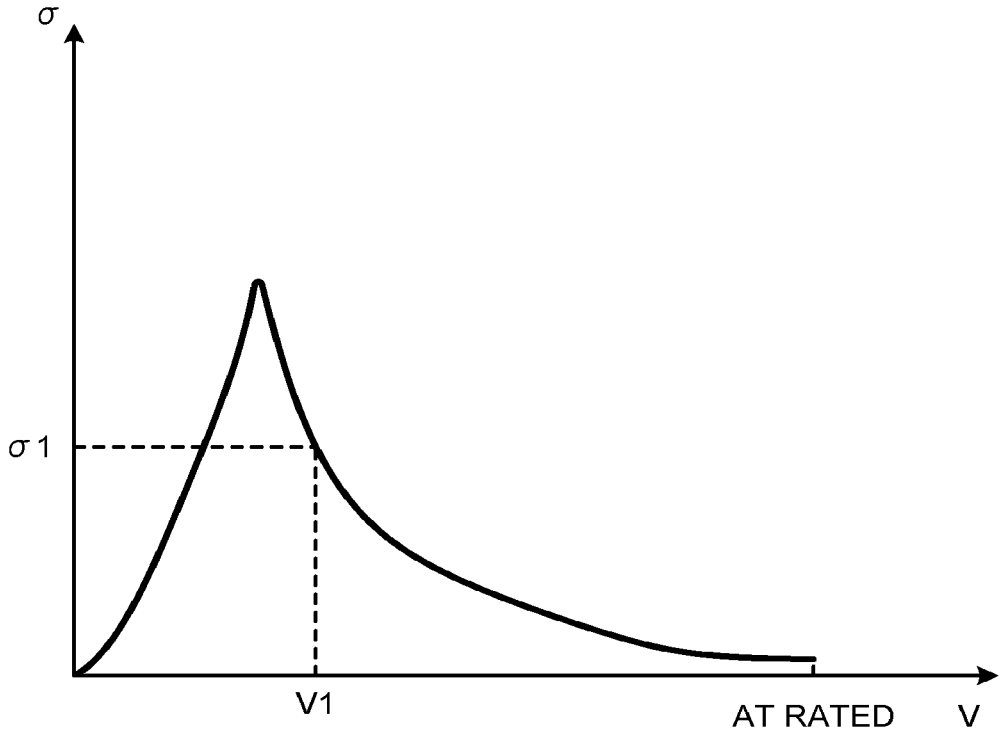
FIG.10 Related Art
FIG. 10 is a chart representing the relationship (vibrating stress characteristics) between a volume flow rate of main steam and a vibrating stress of a rotor blade in the steam turbine according to the related art.

As having been already described (see FIG. 9), under the condition that the volume flow rate of the steam (superheated steam) to be supplied as the working fluid F is lower than that in the case of rated operation, a large-scale reverse flow region Fb sometimes occurs on the base side of the rotor blade 31*a* at the final stage as illustrated in FIG. 2. Therefore, the steam supplied as the working fluid F intensively flows through a part on the tip side of the rotor blade 31*a* at the final stage. Further, under the condition that the volume flow rate is further low, a vortex Fv occurs at a part on the tip side of the rotor blade 31*a* at the final stage. As a result, a vibrating stress sometimes becomes extremely large at the part on the tip side of the rotor blade 31*a* at the final stage. Besides, at the part on the tip side of the rotor blade 31*a* at the final stage, the steam flowing at a saturation temperature significantly decreases and is overheated due to windage loss caused by the rotation of the rotor blade 31*a*, and therefore the temperature of the rotor blade 31*a* increases. As a result of this, the material strength of the rotor blade 31*a* decreases, and the rotor blade 31*a* sometimes expands and extends due to heat.

However, in this embodiment, the spray water W1 sprayed by the spray unit 5 can effectively suppress occurrence of vibrating stress at the rotor blade 31*a* and increase in temperature of the rotor blade 31*a*.

Concretely, the spray water W1 sprayed by the spray unit 5 is heated by obtaining sensible heat and latent heat in the space SP1 (L-0 pre-extraction chamber) demarcated by the diaphragm outer ring 43*a* at the final stage and the inner casing 21. The heated spray water W1 then flows as a mixing fluid S1 into a part where the stationary blades 42 and the rotor blades 31 are alternately arranged inside the inner casing 21 and which is a steam passage through which the working fluid F flows. The mixing fluid S1 flows into the steam passage, in a gas-liquid mixed state in which waterdrop (liquid) and steam (gas) are mixed together or in a gas state in which all of the spray water W1 becomes steam (gas), depending on the condition such as the distance between the spray unit 5 and the steam passage, the temperature of the spray water W1, the spray amount of the spray water W1 or the like.

The mixing fluid S1 flows into spacing between the stationary blade 42*a* at the final stage and a rotor blade 31*b* (L-1 stage rotor blade) at a stage located one stage before the final stage in the steam passage, and then changes in traveling direction due to the flow of the working fluid F. A mixing fluid S2 changed in traveling direction flows through a part located on the outer peripheral side in the steam passage. Here, the mixing fluid S2 flows through a part located on the outer peripheral side of the stationary blade 42*a* at the final stage and then flows into a tip part located on the outer peripheral side of the rotor blade 31*a* at the final stage.

Therefore, in this embodiment, at the tip part of the rotor blade 31*a* at the final stage, the occurrence of the vortex Fv is suppressed due to the flow-in of the mixing fluid S2, so that the vibrating stress decreases. Further, in this embodiment, the mixing fluid S2 contains steam at the saturation temperature and is thus lower in temperature than the working fluid F, and therefore can suppress an increase in temperature at the rotor blade 31*a* at the final stage. As a result of this, in this embodiment, it is possible to prevent a decrease in material strength of the rotor blade 31*a* and expansion and extension of the rotor blade 31*a* due to heat.

Accordingly, in this embodiment, it is possible to easily widen the range of the operational steam flow rate in the low-pressure turbine 104.

For example, in the case where the low-pressure turbine 104 is operated under the following operation condition, when the spray unit 5 sprays the spray water W1 under the following spray condition, the above operation and effect can be preferably produced.

(Operation Condition)

The volume flow rate of steam . . . 25% or less with respect to the volume flow rate in the rated operation (partial-load continuous operation)

(Spray Condition)

The temperature of the spray water W1 . . . 5° C. or higher and 50° C. or lower (the low temperature side is room temperature in a power plant in the winter, and the high temperature side is a temperature obtained by adding a temperature increase (20° C.) at a pump to room temperature (30° C.) in the summer)

The mean particle size of the spray water W1 . . . 100 μm or more and 2 mm or less in Sauter mean diameter (particle size range used in the steam turbine)

Note that, in this embodiment, the plurality of spray units 5 are arranged in the circumferential direction of the turbine rotor 3 (see FIG. 3) as described above. Therefore, in this embodiment, the spray water W1 can be uniformly sprayed in the circumferential direction of the turbine rotor 3.

Further, in this embodiment, the water supply system 6 supplying the cooling water W0 to the spray unit 5 has the flow rate regulating valve V6 as described above. Therefore, in this embodiment, it is possible to regulate the flow rate of the cooling water W0 to be supplied to the spray unit 5 by using the flow rate regulating valve V6. Further, in this embodiment, the water supply system 6 has the temperature regulator 62 as described above. Therefore, in this embodiment, it is possible to regulate the temperature of the cooling water W0 to be supplied to the spray unit 5 by using the temperature regulator 62. As a result of this, in this embodiment, the state in which the spray water W1 sprayed from the spray unit 5 is heated and then flows into the steam passage as the mixing fluid S1, can be appropriately regulated. Accordingly, in this embodiment, it is possible to further effectively prevent erosion of the rotor blade 31*a* and so on.

[Modification Example of the First Embodiment]

In the above-described first embodiment, the spray unit 5 is installed in the space SP1 demarcated by the diaphragm outer ring 43*a* at the final stage and the inner casing 21, and sprays the spray water W1 in the space SP1. This space SP1 allows the spray unit 5 to be easily installed therein and is close to the turbine stage at the final stage, so that the above-described operation and effect can be effectively produced. However, the installation place of the spray unit 5 is not limited to the above-described one. The spray unit 5 may be installed in a space located upstream from the rotor blade 31*a* at the final stage. For example, a space (SP2, SP3 or the like) (L-1 pre-extraction chamber, L-2 pre-extraction chamber) demarcated by a diaphragm outer ring (43*b*, 43*c* or the like) other than the final stage and the inner casing 21. In other words, the spray unit 5 may be configured to spray the spray water W1 in the space (SP1, SP2, SP3 or the like) each located between the plurality of diaphragm support units 211 (211*a*, 211*b*, 211*c*, 211*d* and so on) arranged in the direction of the rotation axis AX and between the outer peripheral surface of the diaphragm outer ring 43 (43*a*, 43*b*, 43*c* or the like) at each stage and the inner peripheral surface of the inner casing 21. Also in this case, the same operation and effect as those in the case of the first embodiment can be produced.

The spray unit 5 in the case of spraying the spray water W1 in a conical shape has been described in the above-described first embodiment, but is not limited to this. For example, the spray unit 5 may be configured to spray the spray water W1 in a fan shape.

The casing 2 in the case of having the double structure has been described in the above-described first embodiment, but is not limited to this. The casing 2 may have a single structure.

The spray unit 5 in the case of being provided in the low-pressure turbine 104 has been described in the above-described first embodiment, but is not limited to this. The spray unit 5 may be installed in a steam turbine other than the above-described low-pressure turbine 104 as necessary.

Further, the above-described spray unit 5 may be installed in the steam turbine, for example, in a single-shaft type combined cycle power generation system heating the working fluid in the steam turbine utilizing exhaust heat of a gas turbine. In this case, cooling steam supplied from the outside at startup can be reduced. Further, the same operation and effect as those in the case of the above-described first embodiment can be produced.

<Second Embodiment>

[Configuration of a Low-pressure Turbine]

Figure 4:
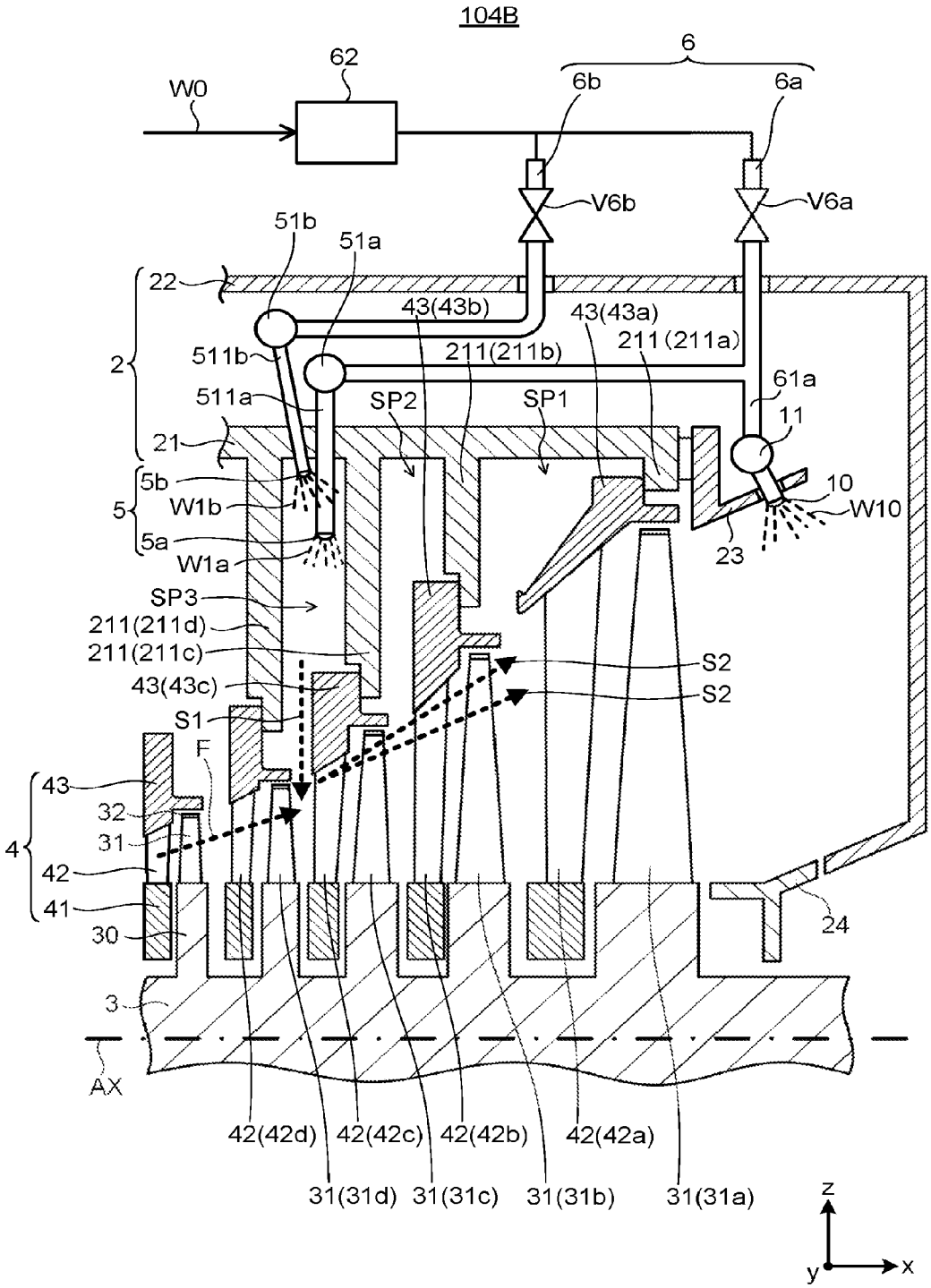
FIG. 4 is a view illustrating a low-pressure turbine in a steam turbine power generation system in a second embodiment.

FIG. 4 is a view illustrating a low-pressure turbine 104B in a steam turbine power generation system in a second embodiment. FIG. 4 illustrates a cross section, similarly to FIG. 2, of a vertical plane (xz plane) and schematically illustrates a part of the low-pressure turbine 104B. Further, in FIG. 4, fluid and its flow field are indicated using heavy broken lines.

As illustrated in FIG. 4, in the low-pressure turbine 104B in this embodiment, unlike the case of the above-described first embodiment (see FIG. 2 and so on), a plurality of spray units 5 are provided. Here, both of a first spray unit 5*a* and a second spray unit 5*b* (auxiliary spray unit) are provided as the spray units 5. Further, there are a plurality of water supply systems 6, and both of a first water supply system 6*a* and a second water supply system 6*b* are provided as the water supply systems 6. Besides, the low-pressure turbine 104B in this embodiment further has an exhaust chamber spray unit 10.

This embodiment is the same as the above-described first embodiment (see FIG. 2 and so on) except the above points and related points. Therefore, description of items in this embodiment overlapping with those in the above embodiment will be appropriately omitted.

[Spray Unit 5]

The first spray unit 5*a* among the plurality of spray units 5 is installed to spray spray water W1*a* in a space SP3 (L-2 pre-extraction chamber) demarcated by a diaphragm outer ring 43*c* provided in the stationary cascade at the third stage from the downstream side and the inner casing 21. In other words, the first spray unit 5*a* is installed in the space SP3 located between the diaphragm support unit 211*c* at the third stage from the downstream side and the diaphragm support unit 211*d* at the fourth stage from the downstream side and between the outer peripheral surface of the diaphragm outer ring 43*c* at the third stage from the downstream side and the inner peripheral surface of the inner casing 21.

The second spray unit 5*b* among the plurality of spray units 5 is an auxiliary spray unit (auxiliary spray device) and installed in the same space SP3 (L-2 pre-extraction chamber) as that of the first spray unit 5*a*. The second spray unit 5*b* is located outside of the first spray unit 5*a* in the radial direction. Here, the second spray unit 5*b* is configured to spray spray water W1*b* (auxiliary spray water) different in mean particle size from the spray water W1*a* sprayed by the first spray unit 5*a*. The second spray unit 5*b* sprays, for example, the spray water W1*b* smaller in mean particle size than the spray water W1*a* sprayed by the first spray unit 5*a*.

For example, the first spray unit 5*a* sprays the spray water W1*a* under the following spray condition, and the second spray unit 5*b* sprays the spray water W1*b* under the following spray condition.

(Spray Condition)

The mean particle size of the spray water W1*a* sprayed by the first spray unit 5*a* . . . 500 μm or more and 1000 μm or less The mean particle size of the spray water W1*b* sprayed by the second spray unit 5*b* . . . 100 μm or more and 500 μm or less (It is preferable to perform selection so that the particle volume of the spray water W1*a* sprayed by the first spray unit 5*a* is about 10 times that of the spray water W1*b* sprayed by the second spray unit 5*b* in the above range. This is because the selection facilitates regulation of the volute of the mixing fluid after evaporation.)

In this embodiment, the first spray unit 5*a* is supplied with cooling water W0 (liquid phase water) from the first water supply system 6*a* via a first manifold 51*a* and sprays the cooling water W0 as the spray water W1*a*. In contrast to this, the second spray unit 5*b* is supplied with cooling water W0

(liquid phase water) from the second water supply system 6*b* via a second manifold 51*b* and sprays the cooling water W0 as the spray water W1*b*.

Figure 5:
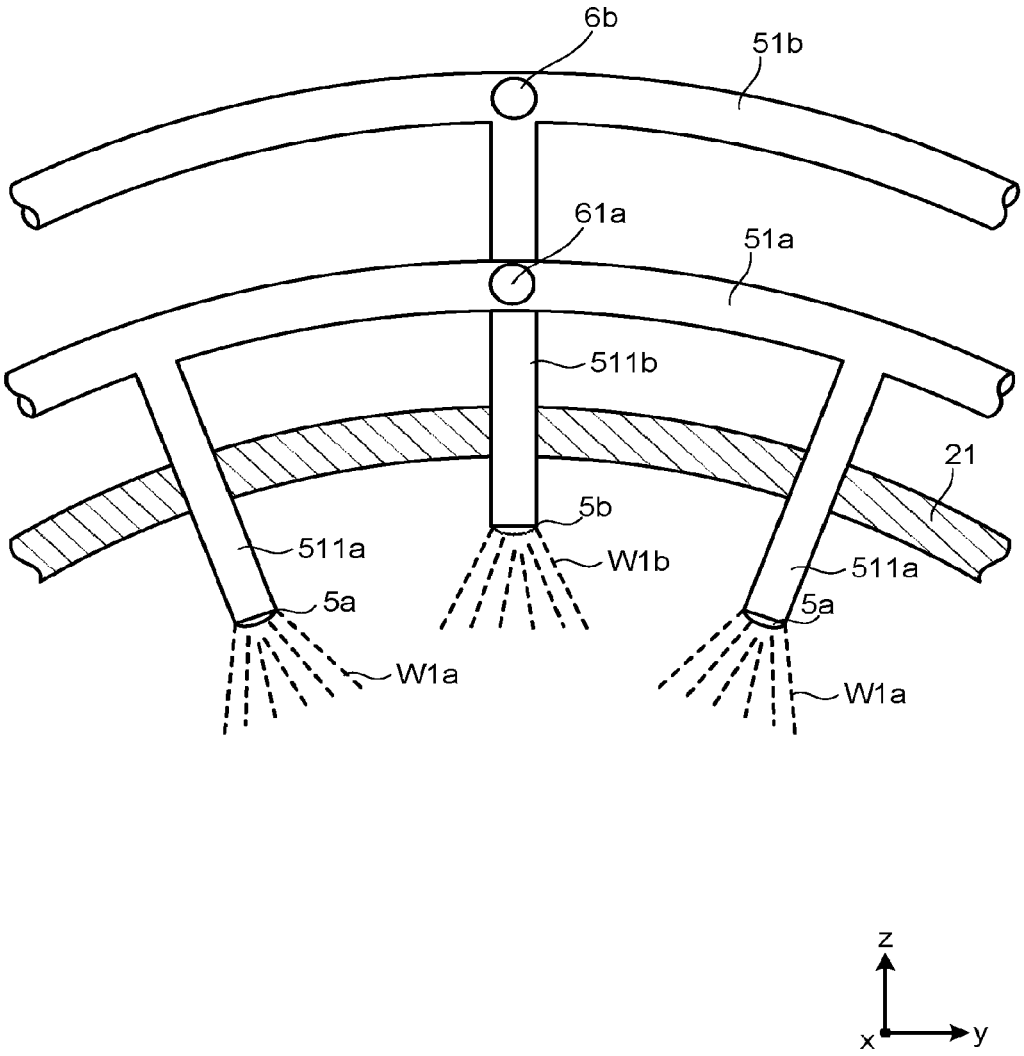
FIG. 5 is a view illustrating a detailed configuration of first spray units and a second spray unit, and a first manifold and a second manifold in the low-pressure turbine in the second embodiment.

FIG. 5 is a view illustrating a detailed configuration of the first spray unit 5*a* and the second spray unit 5*b*, and the first manifold 51*a* and the second manifold 51*b* in the low-pressure turbine 104B in the second embodiment. FIG. 5 illustrates, similarly to FIG. 3, a part of a vertical plane (yz plane) perpendicular to an axial direction (x-direction) along a rotation axis AX.

As illustrated in FIG. 5, the first manifold 51*a* is a ring-shaped pipe surrounding the outer peripheral surface of the inner casing 21 in a circumferential direction. To the first manifold 51*a*, the first water supply system 6*a* is coupled. Further, to the first manifold 51*a*, a plurality of pipes 511*a* extending in the radial direction are coupled on the inner peripheral side. The plurality of pipes 511*a* are arranged at regular intervals in the circumferential direction, and penetrate the inner casing 21. Further, each of the plurality of pipes 511*a* has the first spray unit 5*a* installed at its tip on the inside.

As illustrated in FIG. 5, the second manifold 51*b* is, similarly to the first manifold 51*a*, a ring-shaped pipe surrounding the outer peripheral surface of the inner casing 21 in a circumferential direction. To the second manifold 51*b*, the second water supply system 6*b* is coupled. To the second manifold 51*b*, a pipe 511*b* extending in the radial direction is coupled on the inner peripheral side as in the case of the first manifold 51*a*. Though illustration is omitted, a plurality of the pipes 511*b* are arranged at regular intervals in the circumferential direction, and penetrate the inner casing 21. Further, each of the plurality of pipes 511*b* has the second spray unit 5*b* installed at its tip on the inside.

Further, the plurality of pipes 511*a* coupled to the first manifold 51*a* and the plurality of pipes 511*b* coupled to the second manifold 51*b* are alternately arranged in the circumferential direction.

[Water Supply System 6]

The first water supply system 6*a* among the plurality of water supply systems 6 has, as illustrated in FIG. 4, a pipe through which the cooling water W0 (liquid phase water) to be supplied to the first spray unit 5*a*. The first water supply system 6*a* penetrates the outer casing 22 and supplies the cooling water W0 from the outside of the casing 2 to the first spray unit 5*a*. Further, the first water supply system 6*a* has a branch pipe 61*c* and supplies the cooling water W0 to the exhaust chamber spray unit 10 via the branch pipe 61*c*. Here, the first water supply system 6*a* has a first flow rate regulating valve V6*a* and uses the first flow rate regulating valve V6*a* to regulate the flow rate of the cooling water W0 to be supplied to each of the first spray unit 5*a* and the exhaust chamber spray unit 10. The first flow rate regulating valve V6*a* regulates the flow rate of the cooling water W0 regulated in temperature by the temperature regulator 62.

The second water supply system 6*b* among the plurality of water supply systems 6 has, as illustrated in FIG. 4, a pipe through which the cooling water W0 (liquid phase water) to be supplied to the second spray unit 5*b*. The second water supply system 6*b* penetrates the outer casing 22 and supplies the cooling water W0 from the outside of the casing 2 to the second spray unit 5*b*. Here, the second water supply system 6*b* has a second flow rate regulating valve V6*b* and uses the second low rate regulating valve V6*b* to regulate the flow rate of the cooling water W0 to be supplied to the second spray unit 5*b*. The second flow rate regulating valve V6*b* regulates, similarly to the first flow rate regulating valve V6*a*, the flow rate of the cooling water W0 regulated in temperature by the temperature regulator 62.

[Exhaust Chamber Spray Unit 10]

The exhaust chamber spray unit 10 is, similarly to the spray unit 5, a spray device and has, as illustrated in FIG. 4, a spray head formed to spray spray water W10 (waterdrop), for example, in a conical shape. The exhaust chamber spray unit 10 sprays the spray water W10 in a space (exhaust chamber) between a steam guide 23 and an outlet cone 24 inside the casing 2. This cools a rotor blade 31*a* at the final stage and cools the working fluid F passed through the rotor blade 31*a* at the final stage.

Here, the exhaust chamber spray unit 10 is supplied with cooling water W0 (liquid phase water) from the first water supply system 6*a* via a manifold 11 and sprays the cooling water W0 as the spray water W10. More specifically, the manifold 11 is a ring-shaped pipe surrounding the outer peripheral surface of the steam guide 23 in a circumferential direction, and coupled with the branch pipe 61*c* provided at the first water supply system 6*a*. Further, to the manifold 11, a pipe 111 is coupled on the inner peripheral side. Though illustration is omitted, a plurality of the pipes 111 are provided and arranged side by side at predetermined intervals in the circumferential direction, and penetrate the steam guide 23. Further, at each of the plurality of the pipes 111, the exhaust chamber spray unit 10 is installed at its tip on the inside. In other words, the plurality of exhaust chamber spray units 10 are arranged, similarly to the exhaust chamber spray units 5, at regular intervals in the circumferential direction of the turbine rotor 3 and can spray the spray water W10 concurrently with the exhaust chamber spray units 5.

[Regarding the Operation and Effect of the Spray Waters W1*a*, W1*b*]

Hereinafter, the operation and effect of the spray water W1*a* sprayed by the first spray unit 5*a* and the spray water W1*b* (auxiliary spray water) sprayed by the second spray unit 5*b* will be described.

Both of the spray water W1*a* sprayed by the first spray unit 5*a* and the spray water W1*b* sprayed by the second spray unit 5*b* are heated by obtaining sensible heat and latent heat in the space SP3 demarcated by a diaphragm outer ring 43*c* at the third stage from the downstream side and the inner casing 21, and flow as a mixing fluid S1 into a steam passage through which the working fluid F flows. The heated mixing fluid S1 flows into the steam passage, as in the case of the first embodiment, in a gas-liquid mixed state in which waterdrop (liquid) and steam (gas) are mixed together or in a gas state in which all of the mixing fluid S1 becomes steam (gas).

Then, the mixing fluid S1 flows into spacing between a stationary blade 42*c* (L-2 stage stationary blade) at a stage located two stages before the final stage and a rotor blade 31*d* (L-3 stage rotor blade) at a stage located three stages before the final stage in the steam passage where the working fluid F flows, and then changes in traveling direction due to the flow of the working fluid F. A mixing fluid S2 changed in traveling direction flows through a part located on the outer peripheral side in the steam passage. Here, the mixing fluid S2 flows diffusing in the radial direction from the turbine stage located two stages before the final stage to the turbine stage at the final stage. Then, the mixing fluid S2 flows, at the turbine stage at the final stage, through a part located on the outer peripheral side at the stationary blade 42*a* and then flow into a tip part located on the outer peripheral side at the rotor blade 31*a*.

Therefore, it is possible to decrease the vibrating stress and suppress an increase in temperature at the rotor blade 31*a* at the final stage in this embodiment as in the first embodiment.

Accordingly, in this embodiment, it is possible to easily widen the range of the operational steam flow rate in the low-pressure turbine 104B.

Note that, in this embodiment, the plurality of first spray units 5*a* and the plurality of second spray units 5*b* are alternately arranged in the circumferential direction of the turbine rotor 3 (see FIG. 5). This makes it possible to spray the spray water W1*b* from the second spray units 5*b* for supplement to a part where the spray amount of the spray water W1*a* sprayed from the first spray units 5*a* is small in the circumferential direction. Therefore, in this embodiment, the spray waters W1*a*,W1*b* are uniformly sprayed in the circumferential direction of the turbine rotor 3.

Further, in this embodiment, the first water supply system 6*a* supplying the cooling water W0 to the first spray unit 5*a* has the first flow rate regulating valve V6*a*, and the second water supply system 6*b* supplying the cooling water W0 to the second spray unit 5*b* has the second flow rate regulating valve V6*b*. Therefore, in this embodiment, it is possible to independently regulate the flow rate of the cooling water W0 to be supplied to the first spray unit 5*a* and the flow rate of the cooling water W0 to be supplied to the second spray unit 5*b* respectively by using the first flow rate regulating valve V6*a* and the second flow rate regulating valve V6*b*. Further, in this embodiment, the spray water W1*a* sprayed by the first spray unit 5*a* and the spray water W1*b* sprayed by the second spray unit 5*b* are different in mean particle size from each other. Accordingly, in this embodiment, it is possible to supply the spray waters W1*a*, W1*b* under various conditions, and therefore further easily widen the range of the operational steam flow rate in the low-pressure turbine 104B.

[Modification Example of the Second Embodiment]

The exhaust chamber spray unit 10 in the case of being provided has been described in the above-described second embodiment, but is not limited to this. The exhaust chamber spray unit 10 does not need to be provided as in the case of the first embodiment. Also in this case, arbitrarily setting the conditions of the spray water W1*a* sprayed by the first spray unit 5*a* and the spray water W1*b* sprayed by the second spray unit 5*b* makes it possible to similarly produce the operation and effect by the spray water W10 sprayed by the exhaust chamber spray unit 10.

Both of the first spray unit 5*a* and the second spray unit 5*b* in the case of being installed in the SP3 (L-2 pre-extraction chamber) demarcated by the diaphragm outer ring 43*c* provided at the third stage from the downstream side and the inner casing 21 has been described in the above-described second embodiment, but are not limited to this. Both the first spray unit 5*a* and the second spray unit 5*b* may be installed in a space located upstream from the rotor blade 31*a* at the final stage. For example, both the first spray units 5*a* and the second spray units 5*b* may be installed in the space SP2 (L-1 pre-extraction chamber) demarcated by the diaphragm outer ring 43*b* at the second stage from the downstream side and the inner casing 21 or the like. Besides, both the first spray unit 5*a* and the second spray unit 5*b* may be installed in spaces different from each other.

The spray units 5 spraying the spray waters different in mean particle size in the case of being composed of two kinds (the first spray unit 5*a*, the second spray unit 5*b*) have been described in the above-described second embodiment, but are not limited to this. The spray units 5 spraying the spray waters different in mean particle size may be composed of three kinds or more. Further, for example, a plurality of kinds of spray units 5 connected to the first water supply system 6*a* may be arranged in the circumferential direction.

<Third Embodiment>

[Configuration of a Low-pressure Turbine 104C]

Figure 6:
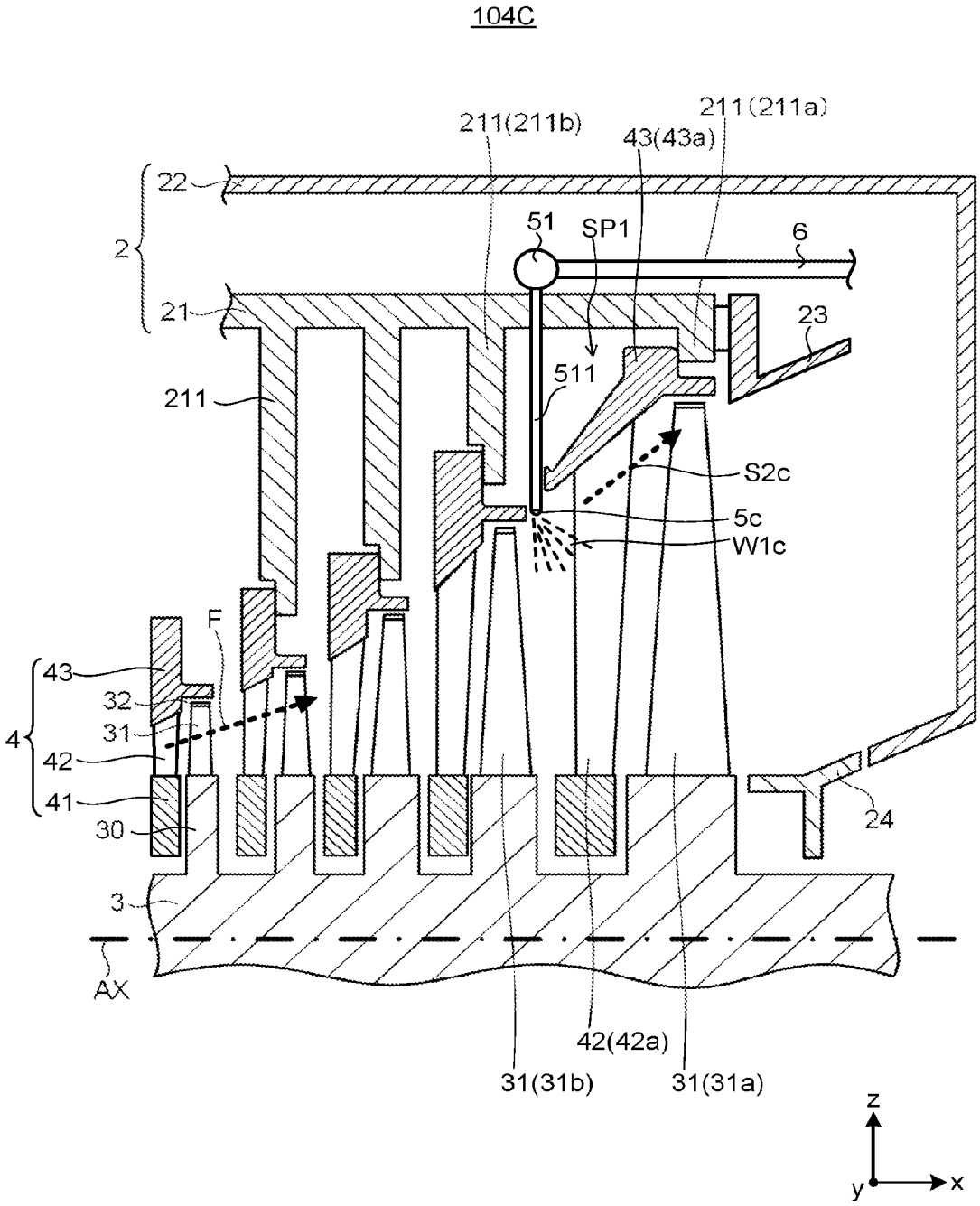
FIG. 6 is a view illustrating a low-pressure turbine in a steam turbine power generation system in a third embodiment.

FIG. 6 is a view illustrating a low-pressure turbine 104C in a steam turbine power generation system in a third embodiment. FIG. 6 illustrates a cross section, similarly to FIG. 2, of a vertical plane (xz plane) and schematically illustrates a part of the low-pressure turbine 104C. Further, in FIG. 6, fluid and its flow field are indicated using heavy broken lines.

As illustrated in FIG. 6, the position where a spray unit 5*c* is installed is different from the case in the first embodiment (see FIG. 2 and so on) in the low-pressure turbine 104C in this embodiment.

This embodiment is the same as the above-described first embodiment (see FIG. 2 and so on) except the above points and related points. Therefore, description of items in this embodiment overlapping with those in the above embodiment will be appropriately omitted.

[Spray Unit 5*c*]

The spray unit 5*c* is installed to directly spray spray water W1*c* toward the steam passage (L-0 inlet) between a stationary blade 42*a* (L-0 stage stationary blade) at the final stage and a rotor blade 31*b* (L-1 stage rotor blade) at one stage before the final stage and through which a working fluid F flows inside the casing 2. In other words, the spray unit 5*c* is installed to be located between a diaphragm support unit 211*a* provided at the final stage and a diaphragm support unit 211*b* provided at a stage one stage before the final stage and inside in the radial direction of the inner peripheral surface of a diaphragm outer ring 43*a* at the final stage.

In this embodiment, the spray unit 5*c* sprays the spray water W1*c* at an outside part in the radial direction of the steam passage.

[Regarding the Operation and Effect of the Spray Water W1*c*]

Hereinafter, the operation and effect of the spray water W1*c* sprayed by the spray unit Sc will be described.

The spray water W1*c* sprayed by the spray unit 5*c* is heated by obtaining sensible heat and latent heat from the working fluid F in the steam passage, and changes in traveling direction due to mixing into the flow of the working fluid F. A mixing fluid S2*c* changed in traveling direction flows in a gas-liquid mixed state in which water-drop (liquid) and steam (gas) are mixed together or in a gas state in which all of the mixing fluid S2*c* becomes steam (gas) as in the case of the first embodiment. Then, the mixing fluid S2*c* flows through a part located on the outer peripheral side at the stationary blade 42*a* at the final stage and then flows into a tip part located on the outer peripheral side of the rotor blade 31*a*.

Therefore, it is possible to decrease the in vibrating stress and suppress an increase in temperature at the rotor blade 31*a* at the final stage in this embodiment as in the first embodiment.

Accordingly, in this embodiment, it is possible to easily widen the range of the operational steam flow rate in the low-pressure turbine 104C.

Note that the mixing fluid S2*c* flowing through the turbine stage at the final stage in this embodiment is lower in temperature than the mixing fluid S2 (see FIG. 2) flowing through the turbine stage at the final stage in the first embodiment. Therefore, it is possible to further effectively cool the rotor blade 31*a* at the final stage in this embodiment than in the first embodiment.

[Modification Example of the Third Embodiment]

The spray unit 5*c* in the case of spraying the spray water W1*c* to the steam passage between the stationary blade 42*a* at the final stage and the rotor blade 31*b* at one stage before the final stage has been described in the above-described third embodiment, but is not limited to this. The spray unit 5*c* may be configured to spray the spray water W1*c* to the steam passage located on the upstream from the rotor blade 31*a* (L-0 stage rotor blade) at the final stage. For example, the spray unit 5*c* may be configured to spray the spray water W1*c* to a part located upstream from the spacing between the stationary blade 42*a* at the final stage and the rotor blade 31*b* at one stage before the final stage in the steam passage. In this case, the same operation and effect as those in the above-described third embodiment can be produced.

<Fourth Embodiment>

[Configuration of a Low-Pressure Turbine 104D]

Figure 7:
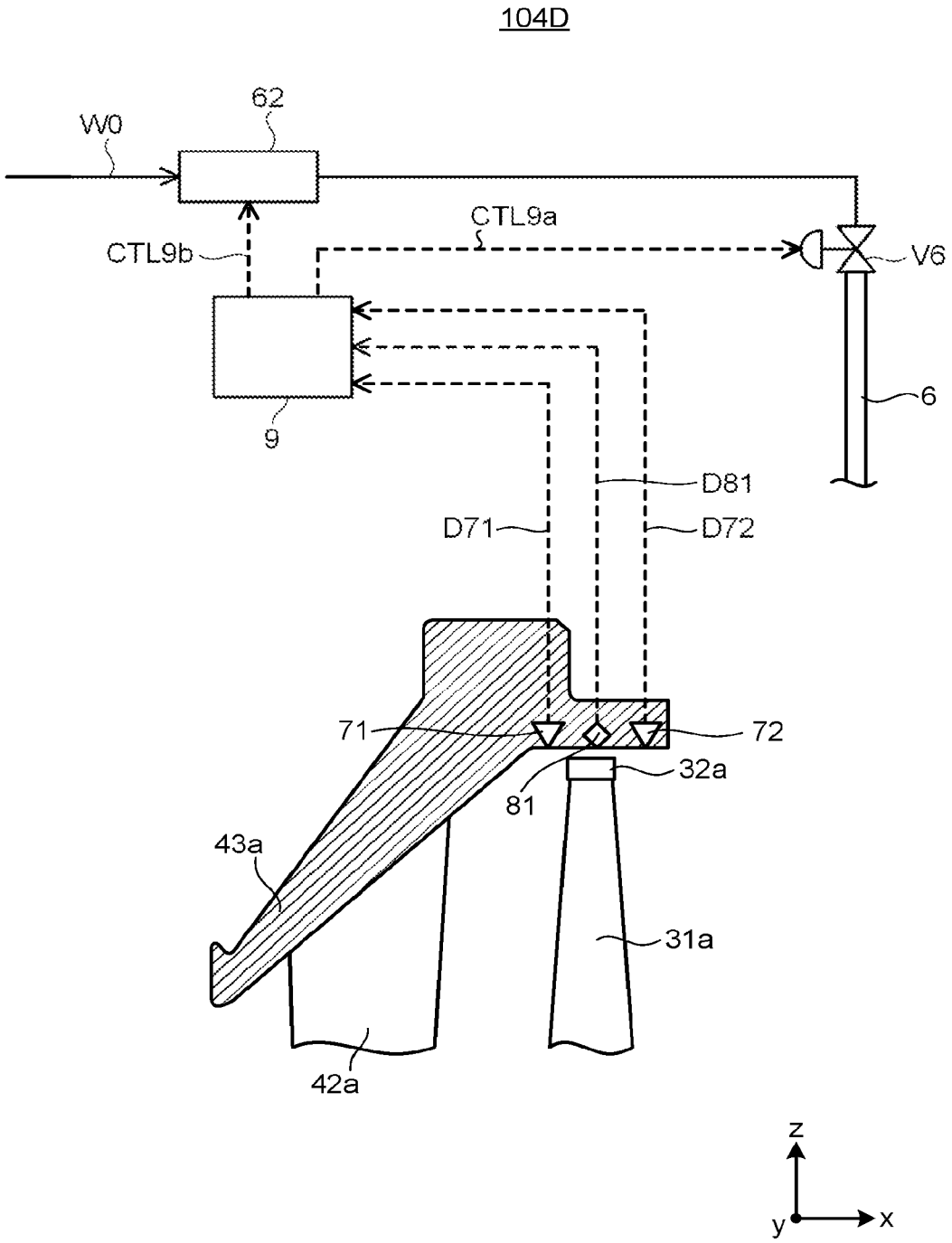
FIG. 7 is a view illustrating an essential part of a low-pressure turbine in a steam turbine power generation system in a fourth embodiment.

FIG. 7 is a view illustrating an essential part of a low-pressure turbine 104D in a steam turbine power generation system in a fourth embodiment. FIG. 7 schematically illustrates a part of a turbine stage at the final stage. In FIG. 7, the left side is the upstream side and the right side is the downstream side as in FIG. 2.

As illustrated in FIG. 7, a first static pressure measurement unit 71, a second static pressure measurement unit 72, a temperature measurement unit 81, and a control unit 9 are further provided in the low-pressure turbine 104D in this embodiment unlike the case of the above-described first embodiment (see FIG. 1).

This embodiment is the same as the above-described first embodiment (see FIG. 1) except the above points and related points. Therefore, description of parts in this embodiment overlapping with those in the above embodiment will be appropriately omitted.

[First Static Pressure Measurement Unit 71]

The first static pressure measurement unit 71 has a pressure sensor and is installed on the inner peripheral surface of a diaphragm outer ring 43*a* (static part) provided at the final stage. Here, the first static pressure measurement unit 71 is installed at a part on the upstream side of a part which the tip of a rotor blade 31*a* at the final stage faces and on the downstream side of a stationary blade 42*a* at the final stage, of the inner peripheral surface of the diaphragm outer ring 43*a* installed at the final stage. The first static pressure measurement unit 71 measures a static pressure P1 and thereby outputs a first static pressure data signal D71.

[Second Static Pressure Measurement Unit 72]

The second static pressure measurement unit 72 has a pressure sensor and is installed on the inner peripheral surface of the diaphragm outer ring 43*a* provided at the final stage, similarly to the first static pressure measurement unit 71. Here, the second static pressure measurement unit 72 is installed, unlike the first static pressure measurement unit 71, at a part on the downstream side of the part which the tip of the rotor blade 31*a* at the final stage faces, of the inner peripheral surface of the diaphragm outer ring 43*a* provided at the final stage. The second static pressure measurement unit 72 measures a static pressure P2 and thereby outputs a second static pressure data signal D72.

[Temperature Measurement Unit 81]

The temperature measurement unit 81 has a temperature sensor and is installed at the inner peripheral surface of the diaphragm outer ring 43*a* provided at the final stage. Here, the temperature measurement unit 81 is installed at the part which the tip of the rotor blade 31*a* at the final stage faces, of the inner peripheral surface of the diaphragm outer ring 43*a* provided at the final stage. In short, the temperature measurement unit 81 is installed between the first static pressure measurement unit 71 and the second static pressure measurement unit 72. The temperature measurement unit 81 measures a temperature T and thereby outputs a temperature data signal D81.

[Control Unit 9]

The control unit 9 is configured so that an arithmetic unit performs arithmetic processing using a program stored in a memory device, and the arithmetic unit executes the arithmetic processing on the basis of an input signal and thereby outputs an output signal.

In this embodiment, the control unit 9 receives input of the first static pressure data signal D71 outputted from the first static pressure measurement unit 71, the second static pressure data signal D72 outputted from the second static pressure measurement unit 72, and the temperature data signal D81 outputted from the temperature measurement unit 81, as input signals. Then, the control unit 9 outputs a control signal CTL9*a* (valve opening degree instruction) to the flow rate regulating valve V6 on the basis of the first static pressure data signal D71, the second static pressure data signal D72, and the temperature data signal D81. Here, the control unit 9 stores, in the memory device, a lookup table in which input signal values of the first static pressure data signal D71, the second static pressure data signal D72, and the temperature data signal D81 are associated with an output signal value of the control signal CTL9*a*, and outputs the control signal CTL9*a* (valve opening degree instruction) according to the input signals, as the output signal using the lookup table. This regulates the flow rate of the cooling water W0 to be supplied to the spray unit 5 via the water supply system 6 (see FIG. 2).

Further, in this embodiment, the control unit 9 outputs a control signal CTL9*b* (temperature regulation instruction) to the temperature regulator 62 on the basis of the temperature data signal D81 and thereby controls the temperature regulating operation of the temperature regulator 62. Here, the control unit 9 stores, in the memory device, for example, a lookup table in which an input signal value of the temperature data signal D81 is associated with an output signal value of the control signal CTL9*b* (temperature regulation instruction), and outputs the control signal CTL9*b* (temperature regulation instruction) according to the input signal, as the output signal using the lookup table. This regulates the temperature of the cooling water W0 to be supplied to the spray unit 5 via the water supply system 6 (see FIG. 2).

Note that the control unit 9 may be configured to store, in the memory device, functions representing the relationship between the input signal values and the output signal values, and output the control signals CTL9*a*, CTL9*b* according to the input signals using the functions.

[Regarding Control of the Flow Rate Regulating Valve V6, and its Operation and Effect]

Hereinafter, detailed contents when the control unit 9 controls the operation of the flow rate regulating valve V6 will be described, and its operation and effect will be described.

Figure 8:
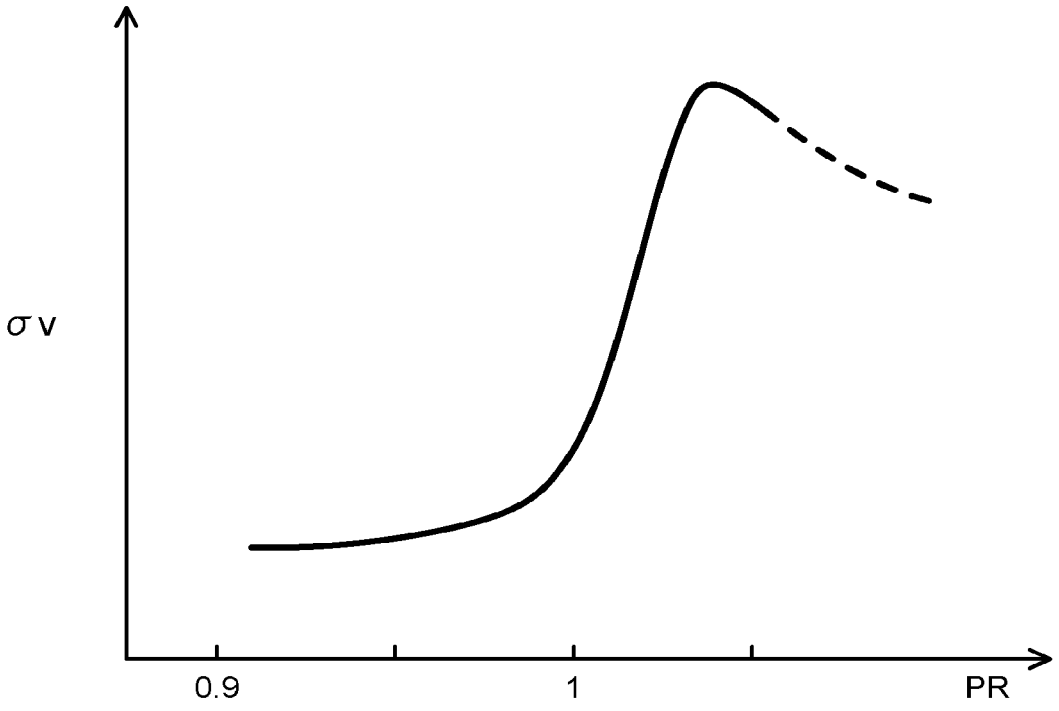
FIG. 8 is a chart representing the relationship between a pressure ratio PR and a vibrating stress σv.

FIG. 8 is a chart representing the relationship between a pressure ratio PR and a vibrating stress σv. In FIG. 8, the horizontal axis indicates the pressure ratio PR and the vertical axis indicates the vibrating stress σv. The pressure ratio PR is a value obtained by dividing the static pressure P2 on the downstream side measured by the second static pressure measurement unit 72 by the static pressure P1 on the upstream side measured by the first static pressure measurement unit 71 (namely, PR=P2/P1). Further, the static pressure P1 on the upstream side corresponds to a signal value of the first static pressure data signal D71, and the static pressure P2 on the downstream side corresponds to a signal value of the second static pressure data signal D72.

As illustrated in FIG. 8, when the pressure ratio PR exceeds 1.0 (namely, PR>1.0), the vibrating stress σv rapidly increases.

Therefore, in this embodiment, the control unit 9 calculates the pressure ratio PR obtained by dividing the static pressure P2 on the downstream side by the static pressure P1 on the upstream side (PR=P2/P1) on the basis of the first static pressure data signal D71 and the second static pressure data signal D72, and determines whether or not the calculated pressure ratio PR is a value larger than 1.0. Then, when it is determined that the calculated pressure ratio PR is a value larger than 1.0 (namely, PR>1.0), the control unit 9 outputs the control signal CTL9*a* (valve opening degree instruction) to open the flow rate regulating valve V6 (see FIG. 7). Here, the control signal CTL9*a* (valve opening degree instruction) is outputted to make the opening degree of the flow rate regulating valve V6 large according to a differential value ΔPR (ΔPR=PR−1.0) between the calculated pressure ratio PR and 1.0. In contrast, when it is determined that the value of the calculated pressure ratio PR is 1.0 or less (namely, PR≤1.0), the control unit 9 outputs the control signal CTL9*a* (valve opening degree instruction) to bring the flow rate regulating valve V6 into a closed state.

In addition to the above, in this embodiment, the control unit 9 determines whether or not the temperature T measured by the temperature measurement unit 81 is higher than a predetermined upper limit temperature Th (restrictive temperature) on the basis of the temperature data signal D81. Then, when it is determined that the temperature T measured by the temperature measurement unit 81 is higher than the predetermined upper limit temperature Th (namely, T>Th), the control unit 9 outputs the control signal CTL9*a* (valve opening degree instruction) to open the flow rate regulating valve V6. Here, the control signal CTL9*a* (valve opening degree instruction) is outputted to make the opening degree of the flow rate regulating valve V6 large according to a differential value ΔT (ΔT=T−Th) between the temperature T measured by the temperature measurement unit 81 and the predetermined upper limit temperature Th. In contrast, when it is determined that the temperature T measured by the temperature measurement unit 81 is the predetermined upper limit temperature Th or lower (namely, T≤Th), the control unit 9 outputs the control signal CTL9*a* (valve opening degree instruction) to decrease the opening degree of the flow rate regulating valve V6.

As described above, in this embodiment, the opening degree of the flow rate regulating valve V6 is controlled according to the first static pressure data signal D71, the second static pressure data signal D72, and the temperature data signal D81 to regulate the flow rate of the cooling water W0 to be supplied to the spray unit 5 via the water supply system 6 (see FIG. 2). Here, when the vibrating stress σv becomes larger (when PR>1.0) and when the temperature T is higher (when T>Th) near the tip of the rotor blade 31*a* at the final stage, spray of the spray water W1 (see FIG. 2) is performed. Therefore, it is possible to suppress occurrence of the vibrating stress at the rotor blade 31*a* at the final stage in this embodiment as in the first embodiment (see FIG. 2). In addition to this, it is possible to suppress an increase in temperature at the rotor blade 31*a* at the final stage in this embodiment as in the first embodiment (see FIG. 2), and therefore to suppress a decrease in material strength of the rotor blade 31*a* and thermal extension of the rotor blade.

On the other hand, when the vibrating stress σv is small and the temperature is low near the tip of the rotor blade 31*a* at the final stage, the spray of the spray water W1 (see FIG. 2) is stopped. Therefore, in this embodiment, it is possible to effectively prevent erosion of the rotor blade 31*a* and so on due to the spray of the spray water W1 (see FIG. 2).

[Regarding Control of the Temperature Measurement Unit 81, and its Operation and Effect]

Hereinafter, detailed contents when the control unit 9 controls the operation of the temperature regulator 62 will be described, and its operation and effect will be described.

In this embodiment, the control unit 9 determines whether or not the temperature T measured by the temperature measurement unit 81 is higher than the predetermined upper limit temperature Th (restrictive temperature) on the basis of the temperature data signal D81. Then, when it is determined that the temperature T measured by the temperature measurement unit 81 is higher than the predetermined upper limit temperature Th (restrictive temperature) (namely, T>Th), the control unit 9 outputs the control signal CTL9*b* (temperature regulation instruction) to cause the temperature regulator 62 to decrease the temperature of the cooling water W0 to a predetermined temperature.

As described above, in this embodiment, the operation of the temperature regulator 62 is controlled according to the temperature data signal D81 to regulate the temperature of the cooling water W0 to be supplied to the spray unit 5 via the water supply system 6 to a predetermined temperature (see FIG. 2). Here, when the temperature T is high (when T>Th) near the tip of the rotor blade 31*a* at the final stage, the temperature of the spray water W1 (see FIG. 2) is decreased to the predetermined temperature. Therefore, in this embodiment, it is possible to effectively suppress an increase in temperature at the rotor blade 31*a* at the final stage and therefore to further suppress a decrease in material strength of the rotor blade 31*a* and thermal extension of the rotor blade.

Accordingly, in this embodiment, it is possible to easily widen the range of the operational steam flow rate in the low-pressure turbine 104D as in the case of the first embodiment (see FIG. 1).

[Modification Example of the Fourth Embodiment]

The temperature measurement unit 81 in the case of being installed at the part which the tip of the rotor blade 31*a* at the final stage faces, of the inner peripheral surface of the diaphragm outer ring 43*a* installed at the final stage (see FIG. 7) has been described in the above-described fourth embodiment, but is not limited to this. The temperature measurement unit 81 may be installed, similarly to the first static pressure measurement unit 71, at a part on the upstream side of the part which the tip of the rotor blade 31*a* at the final stage faces and on the downstream side of a nozzle rear end, of the inner peripheral surface of the diaphragm outer ring 43*a* installed at the final stage. Besides, the temperature measurement unit 81 may be installed, similarly to the second static pressure measurement unit 72, at a part on the downstream side of the part which the tip of the rotor blade 31*a* at the final stage faces, of the inner peripheral surface of the diaphragm outer ring 43*a* installed at the final stage. In these cases, it is possible to suppress erosion of the temperature measurement unit 81 due to the waterdrop released from the tip of the rotor blade 31*a*.

The flow rate regulating valve V6 in the case of being opened when the pressure ratio PR obtained by dividing the static pressure P2 on the downstream side by the static pressure P1 on the upstream side (PR=P2/P1) is a value larger than 1.0 (namely, PR>1.0) and being closed when the pressure ratio PR is 1.0 or less (namely, PR≤1.0) has been described in the above-described fourth embodiment, but is not limited to this. For example, the flow rate regulating valve V6 may be controlled to open when the pressure ratio PR is a value larger than a value obtained by subtracting an arbitrary margin value α from 1.0 (namely, PR>1.0−α) and to close when the pressure ratio PR is a value equal to or smaller than the value (namely, PR≤1.0−α). The margin value α is arbitrarily set in consideration of, for example, characteristics such as the measurement accuracy (error) of the pressure sensor or the like.

Both of the static pressure P1 on the upstream side and the static pressure P2 on the downstream side can be obtained by measuring a differential pressure DP between them and adding the differential pressure DP to an absolute pressure measured for one of them (P1 or P2). Therefore, when the absolute pressure of the static pressure P1 on the upstream side is measured, the above-described pressure ratio PR (PR=P2/P1) is obtained according to the following Expression (A). Accordingly, the margin value α is arbitrarily set in consideration of an error in the absolute pressure of the static pressure P1 and an error in the differential pressure DP.

$$PR=(P1+DP)/P1 \qquad \text{Expression (A)}$$

Concretely, it is assumed that the sensor accuracy is 1% of a full range in 20% of a full range of the pressure sensor, the presumed differential pressure DP has an error of 0.05 (=1%/20%). Similarly, it is assumed that the error in the absolute pressure of the static pressure P1 on the upstream side is 0.05, the pressure ratio PR comes to have an error of 0.05 in a denominator and a numerator in the above Expression (A). In this case, the error in the pressure ratio PR becomes about 0.1 at most, and therefore the margin value α is set to 0.1, and the flow rate regulating valve V6 is controlled to open when the pressure ratio PR exceeds 0.9. As described above, the margin value α is arbitrarily set in consideration of, for example, characteristics such as the measurement accuracy (error) of the pressure sensor or the like.

The cooling water W0 to be supplied to the spray unit 5 configured similarly to the first embodiment (see FIG. 2) in the case of being regulated in flow rate and regulated in temperature has been described in the above-described fourth embodiment, but is not limited to this. The cooling water W0 to be supplied to the first spray unit 5*a* and the second spray unit 5*b* installed as the spray units 5 in the second embodiment (see FIG. 4) may be regulated in flow rate and regulated in temperature as in this embodiment. Similarly, the cooling water W0 to be supplied to the spray unit 5*c* in the third embodiment (see FIG. 6) may be regulated in flow rate and regulated in temperature as in this embodiment.

The control unit 9 in the case of outputting the control signal CTL9*a* (valve opening degree instruction) to the flow rate regulating valve V6 on the basis of the first static pressure data signal D71, the second static pressure data signal D72, and the temperature data signal D81 to thereby regulate the flow rate of the cooling water W0 to be supplied to the spray unit 5 has been described in the above-described fourth embodiment, but is not limited to this. The control unit 9 may be configured to regulate the flow rate of the cooling water W0 to be supplied to the spray unit 5 on the basis of the temperature data signal D81 without using the first static pressure data signal D71 and the second static pressure data signal D72. Besides, the control unit 9 may be configured to regulate the flow rate of the cooling water W0 to be supplied to the spray unit 5 on the basis of the first static pressure data signal D71 and the second static pressure data signal D72 without using the temperature data signal D81. In short, the spray unit 5 may be driven to perform spray when one of the vibrating stress and the temperature reaches the restrictive value.

<Others>

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine, comprising:

a casing including a plurality of support units;

a turbine rotor housed inside the casing, each of the plurality of support units elongating to a radial direction of the turbine rotor;

a rotor blade cascade having a plurality of rotor blades arranged in a circumferential direction of the turbine rotor;

a stationary blade cascade having a plurality of stationary blades arranged in the circumferential direction of the turbine rotor between a diaphragm inner ring and a diaphragm outer ring, the diaphragm outer ring being supported by each of the plurality of support units, the rotor blade cascade and the stationary blade cascade being each arranged at a plurality of stages alternately in an axial direction of the turbine rotor; and a spray unit including a plurality of pipes connected with a manifold supplied with only liquid phase water to be sprayed, the manifold being located around the casing, each one of the plurality of pipes penetrating only the casing in the radial direction, each tip of each one of the plurality of pipes located in a space being demarcated by the diaphragm outer ring and one of the plurality of support units of the casing, the space being located upstream from a rotor blade cascade at a final stage among the rotor blade cascades at the plurality of stages inside the casing, the liquid phase water being sprayed from the tip to the space as a spray water.

2. The steam turbine according to claim 1, wherein the spray unit sprays the spray water to the space demarcated by the diaphragm outer ring provided in a stationary blade cascade at a final stage among the stationary blade cascades at the plurality of stages and the casing.

3. The steam turbine according to claim 1, wherein the spray unit sprays the spray water to a steam passage through which steam flows as a working medium.

4. The steam turbine according to claim 3, wherein the spray unit sprays the spray water between a stationary blade provided in a stationary blade cascade at a final stage among the stationary blade cascades at the plurality of stages and a rotor blade provided in a rotor blade cascade at one stage before the final stage among the rotor blade cascades at the plurality of stages in the steam passage.

5. The steam turbine according to claim 1, further comprising a flow rate regulating valve for regulating a flow rate of cooling water to be supplied to the spray unit, wherein the spray unit sprays the cooling water regulated in flow rate by the flow rate regulating valve as the spray water.

6. The steam turbine according to claim 1, further comprising a temperature regulator for regulating a temperature of a cooling water to be supplied to the spray unit, wherein the spray unit sprays the cooling water regulated in temperature by the temperature regulator as the spray water.

7. The steam turbine according to claim 1, further comprising:

a flow rate regulating valve for regulating a flow rate of cooling water to be supplied to the spray unit;

a first static pressure measurement unit installed at a static part which a tip of the rotor blade cascade at the final stage among the rotor blade cascades at the plurality of stages faces and a part located upstream from the rotor blade cascade at the final stage, and measuring a static pressure and thereby outputting a first static pressure data signal;

a second static pressure measurement unit installed at the static part which the tip of the rotor blade cascade at the final stage among the rotor blade cascades at the plurality of stages faces and a part located downstream from the rotor blade cascade at the final stage, and measuring a static pressure and thereby outputting a second static pressure data signal; and a control unit for controlling an opening degree of the flow rate regulating valve on a basis of the first static pressure data signal and the second static pressure data signal.

8. The steam turbine according to claim 7, further comprising a temperature measurement unit installed at the static part which the tip of the rotor blade cascade at the final stage among the rotor blade cascades at the plurality of stages faces, and measuring a temperature and thereby outputting a temperature data signal, wherein the control unit controls the opening degree of the flow rate regulating valve on a basis of the first static pressure data signal, the second static pressure data signal, and the temperature data signal.

9. The steam turbine according to claim 8, further comprising a temperature regulator for regulating a temperature of the cooling water to be supplied to the spray unit, wherein the control unit controls an operation of the temperature regulator on a basis of the temperature data signal.

10. The steam turbine according to claim 1, further comprising:

a flow rate regulating valve for regulating a flow rate of cooling water to be supplied to the spray unit;

a temperature measurement unit installed at a static part which a tip of the rotor blade cascade at the final stage among the rotor blade cascades at the plurality of stages faces, and measuring a temperature and thereby outputting a temperature data signal; and a control unit for controlling an opening degree of the flow rate regulating valve on a basis of the temperature data signal.

11. The steam turbine according to claim 1, wherein a plurality of the spray units are arranged in the circumferential direction of the turbine rotor.

12. The steam turbine according to claim 11, wherein the plurality of spray units include:

a first spray unit; and a second spray unit for spraying spray water different in mean particle size from spray water sprayed by the first spray unit, and wherein a plurality of the first spray units and a plurality of the second spray units are alternately arranged in the circumferential direction of the turbine rotor.

13. The steam turbine according to claim 12, further comprising:

an exhaust chamber spray unit for spraying the spray water to an exhaust chamber of the casing;

a first water supply system through which cooling water to be supplied to the first spray units and the exhaust chamber spray unit flows; and a second water supply system through which cooling water to be supplied to the second spray units flow, wherein the exhaust chamber spray unit sprays the cooling water supplied from the first water supply system as the spray water, wherein the first spray units are supplied with the cooling water to be supplied to the exhaust chamber spray unit branched in the first water supply system, and sprays the cooling water as the spray water, and wherein the second spray units spray the cooling water supplied from the second water supply system as the spray water.

* * * * *